US008978719B2

(12) United States Patent
Nevo et al.

(10) Patent No.: US 8,978,719 B2
(45) Date of Patent: Mar. 17, 2015

(54) BAG'S FITTING AND A BAG WITH SAID FITTING

(76) Inventors: Shlomo Nevo, Tel Aviv (IL); Moshe Malik, Karmiel (IL); Jonathan Knann, Kiryat Ono (IL)

( * ) Notice: Subject to any disclaimer, the term of this patent is extended or adjusted under 35 U.S.C. 154(b) by 491 days.

(21) Appl. No.: 13/255,677

(22) PCT Filed: Mar. 9, 2010

(86) PCT No.: PCT/IL2010/000189
§ 371 (c)(1),
(2), (4) Date: Oct. 7, 2011

(87) PCT Pub. No.: WO2010/103512
PCT Pub. Date: Sep. 16, 2010

(65) Prior Publication Data

US 2012/0018040 A1 Jan. 26, 2012

Related U.S. Application Data

(60) Provisional application No. 61/209,491, filed on Mar. 9, 2009.

(51) Int. Cl.
*B65B 1/04* (2006.01)
*B65D 30/24* (2006.01)
*B65B 55/20* (2006.01)

(52) U.S. Cl.
CPC ..... *B65D 31/14* (2013.01); *B65B 55/20* (2013.01); *B65D 2203/00* (2013.01); *B65D 2581/05* (2013.01)
USPC ..... 141/373; 141/114; 141/386

(58) Field of Classification Search
CPC ..... B65B 1/00; B65B 1/106; B65B 1/18; B65B 3/17
USPC ..... 141/10, 114, 314–317, 351, 373, 141/383–386; 222/180–181.3
See application file for complete search history.

(56) References Cited

U.S. PATENT DOCUMENTS 3,907,166 A * 9/1975 Bassignani ..... 222/42
4,947,335 A * 8/1990 Blitchington ..... 700/116
5,899,248 A * 5/1999 Anderson ..... 141/358
6,772,808 B2 * 8/2004 Hinterschuster ..... 141/362
(Continued)

FOREIGN PATENT DOCUMENTS

WO WO 2005/091721 A2 10/2005
WO WO 2010/103512 9/2010

OTHER PUBLICATIONS

International Preliminary Report on Patentability Dated Sep. 13, 2011 From the International Bureau of WIPO Re. Application No. PCT/IL2010/000189.
International Search Report and the Written Opinion Dated Jun. 29, 2010 From the International Searching Authority Re. Application No. PCT/IL2010/000189.
(Continued)

*Primary Examiner* — Timothy L Maust

(57) ABSTRACT

A fitting and a coupled bag and fitting. The coupled bag and fitting is provided wherein (a) the bag's opening is attached to the lower side of the fitting; (b) the fitting designed to easily connect and disconnect, the bag and fitting, on and out of a dispenser or a dispensers mounting-shoe; and (c) the fitting has at least one passage that enables material to pass from the dispenser into the bag. Further embodiments can also contain a mechanism for cleaning leftover from the dispensers outlet, an identification means enable recognizing the existence of the bag and bag's characters.

6 Claims, 4 Drawing Sheets

(56) References Cited

U.S. PATENT DOCUMENTS

| | | | | |
|---|---|---|---|---|
| 7,398,804 | B2 * | 7/2008 | Koch et al. | 141/315 |
| 7,946,316 | B2 * | 5/2011 | Sarnoff et al. | 141/329 |
| 2008/0272148 | A1 | 11/2008 | Malik et al. | |

OTHER PUBLICATIONS

International Search Report dated Jun. 29, 2010 (in English) in counterpart International Application No. PCT/IL2010/000189.

* cited by examiner

BAG'S FITTING AND A BAG WITH SAID FITTING

This application is a U.S. National Phase Application under 35 USC 371 of International Application PCT/IL2010/000189 filed Mar. 9, 2010.

FIELD OF THE INVENTION

The present invention relates to the field of packaging. More specifically, the present invention relates to the field of bags and fitting, particularly for filling bags using a dispenser.

BACKGROUND

Some bulk products are packaged in bags by dispensing machines, these machines usually fills bags automatically. Still there are cases that the work must be done manually. For example, in order 10 protect a product in its package bags that were just filled with foam are inserted in the spaces of the package, the foam is harden in few seconds and holds the product in place. For this purpose the present invention provides a fitting to be coupled with bag enabling fast connection to a dispenser.

Hence, these bags and fitting are useful for filling bags with foam materials. The foam—e.g., polyurethane foam—is generally created by mixing two chemicals components and this foam is hardened within 10-30 seconds. In some cases, a foam dispenser is used to dispense small portions of foam directly into a dedicated bag and these bags, filled with the foam's portions, are used for packaging.

The present invention is particularly useful for the dispenser that is described in the patent application PCT/IL2005/000356, which was published on Oct. 6, 2005 under the number WO 2005/091721.

Since foam is hardened within few seconds, the duration of connecting and disconnecting the bag to and of a dispenser is critical and must be as short as possible. Moreover, if the dispensing process stops for more than few seconds the leftover foam in the dispenser's outlet hardens and should be removed before continuing dispensing.

The fitting and the attached bag of the present invention enables the connection of a bag to the dispenser and to disconnect it quickly and easily. It also can be accessorized by a mechanism that is located on the fitting, which removes leftover foam from the dispenser's outlet during the connection or disconnection.

SUMMARY OF THE INVENTION

The present invention is a bag's fitting and a bag with said fitting, particularly for connecting bags to a dispenser and in some cases to a mounting-shoe that is installed on the dispenser's outlet.

The main object of the present invention is to provide a bag, with a fitting that is attached to its opening, enables to connect this bag fast and easy to the outlet of a dispenser and to fast and easy to remove it after filling. The fitting of the present invention is designed for this purpose and a bag can be attached to this fitting by way of welding, gluing or any other form of attachment.

The fitting can includes a mechanism e.g., flexible stripe, a tooth or a rouge portion, which partly raised of the fitting's upper surface and located on the upper surface of the fitting. While the fitting is connected or disconnected, the mechanism slides along the dispenser outlet and removes any leftover.

Moreover, the fitting can includes information for identifying its existence and the characters of the attached bag. Color of the fitting can use for visual identification, but also can includes printed information e.g., barcode, imprinting codes, holograms, chip or holes in a particular location.

According to a preferred embodiment of the present invention a bag's fitting is provided designed to enable attaching bag's inlet to the lower side of the fitting in order to easily connect and disconnect the fitting with the bag on and out of a dispenser. This fitting has at least one passage that enables material to pass from the dispenser to the bag.

According to another preferred embodiment of the present invention, the provided bag's fitting further includes a connecting means enabling to connect it to a dispenser or to a mounting-shoe of a dispenser. This connecting means can be bayonet, Velcro, magnet or any other connecting means.

According to another preferred embodiment of the present invention, the provided bag's fitting further includes sliders or edges for sliding into guide rails that are located on the mounting-shoe that is installed on the outlet of the dispenser.

According to another preferred embodiment of the present invention, the provided bag's fitting further includes a cleaning means, in order to remove any leftover from the dispenser's outlet, while connecting or disconnecting it. This cleaning means can be a flexible stripe, a tooth or a rouge portion, which partly raised of the fitting's upper surface and located on the upper surface of the fitting in the way that it slides along the dispenser outlet, while inserting or removing the fitting, and removes any leftover.

According to yet another preferred embodiment of the present invention, the provided bag's fitting further includes an identification means in order to identify the existence of the fitting and/or to identify bag's characters. The identification means can be printed on the fitting, imprinted on it, can be hologram, chip or by a way of hole or holes located in a particular location of the fitting. While using holes for identification, identifying can be done by the existence or non existence or a combination of the holes in a particular location in the fitting, and at least one of these holes can be used for identification by the way of allowing passage—when the hole is exists—a light from a source to a sensor or blocking the light when the hole dose not exists.

According to another aspect of the present invention a coupled bag and fitting is provided wherein (a) the bag's opening is attached to the lower side of the fitting; (b) the fitting designed to easily connect and disconnect, the bag and fitting, on and out of a dispenser or a dispenser's mounting-shoe; and (c) the fitting has at least one passage that enables material to pass from the dispenser into the bag.

According to a preferred embodiment the coupled bag and a fitting of the present invention is provided, wherein the fitting further includes a connecting means enabling to connect it to a dispenser or to a mounting-shoe of a dispenser. The connecting means can be bayonet. Velcro, magnet or any other connecting means. Moreover, the fitting can further includes sliders or edges for sliding into guide rails that are located on the mounting-shoe of the dispenser.

According to another preferred embodiment of the present invention the coupled bag and fitting is provided, wherein the fitting further includes a cleaning means, in order to remove any leftover from the dispenser's outlet, while connecting or disconnecting the fitting. This cleaning means can be a flexible stripe, a tooth or a rouge portion, which partly raised of the fitting's upper surface and located on the upper surface of the fitting in the way that it slides along the dispenser outlet, while inserting or removing the fitting, and removes any leftover.

According to another preferred embodiment of the present invention the coupled bag and fitting is provided with identification means in order to identify the existence of the fitting and/or to identify the characters of the attached bag. The identification means can be printed on the fitting imprinted on it or by a way of hole or holes in particular locations on the fitting. The identification, using the holes, is done by the existence or non existence or a combination of the holes in a specific location in the fitting.

BRIEF DESCRIPTION OF THE FIGURES

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the figures.

A DETAILED DESCRIPTION OF PREFERRED EMBODIMENTS

Figure 1:
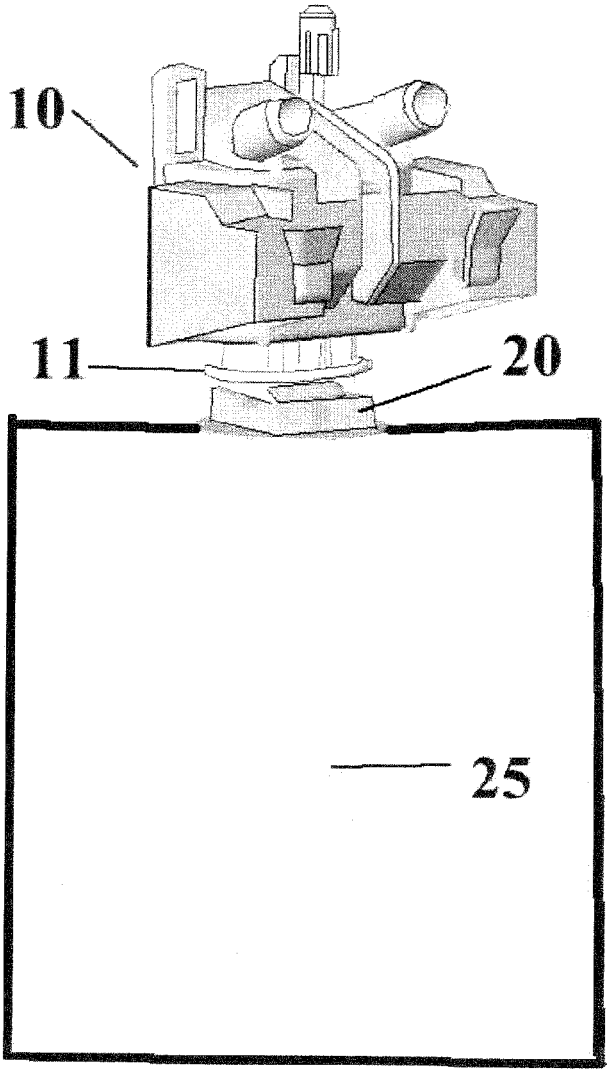
FIG. 1 illustrates the use of the present invention with a preferred embodiment.

The present invention is a bag's fitting and a bag coupled with the fitting. The principles and operation of the present invention may be better understood with reference to the drawing and the accompanying description.

The description is refers to three figures. FIG. 1 illustrates the use of the present invention using a preferred embodiment. The supplying unit of a dispenser 10 is shown with its outlet 11 on which the mounting-shoe (not shown) is installed. A bag's fitting 20 with an attached bag 25 is connected to the outlet 11 by sliding in the fitting 20 through the guide rails that are located beside the dispenser's outlet. The produced foam is passed through the fitting 20 directly to the bag 25.

Figure 2:
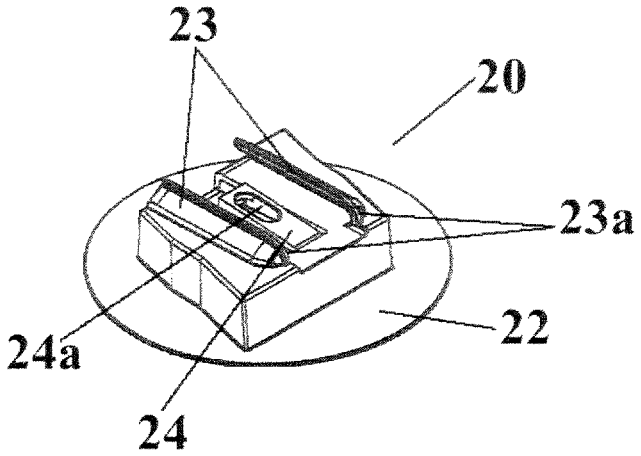
FIG. 2 illustrates an embodiment of the bag's fitting of the present invention.

FIG. 2 illustrates a preferred embodiment of the bag's fitting according to the present invention. The bag's fitting 20 is comprised of a base rim 22 onto which the bag's opening is welded; two sliders 23—with a passage between and with edge stoppers 23*a*—to enable slide-in of the fitting onto the guide rails of the dispenser's mounting shoe (as deep as the edge stoppers 23*a* allow); a flexible stripe 24 with partly raised surface 24*b* whose edges are connected in the fitting's passage. The corner of the raised surface removes the leftover foam from the dispenser's outlet while the fitting slides-in to the mounting shoe. The raised surface 24*b* is also compensates for any high deviation of the dispenser's outlet; and a passage 24*a* in the raised surface of the flexible stripe, which enables foam to pass through, from the dispenser into the bag. While the fitting 20 is connected to the dispenser's outlet 11 and a bag 25 is attached, wherein its opening is welded to the fitting's base rim 22, the foam is dispensed through the dispenser's outlet 11 directly into the bag 25.

Figure 3:
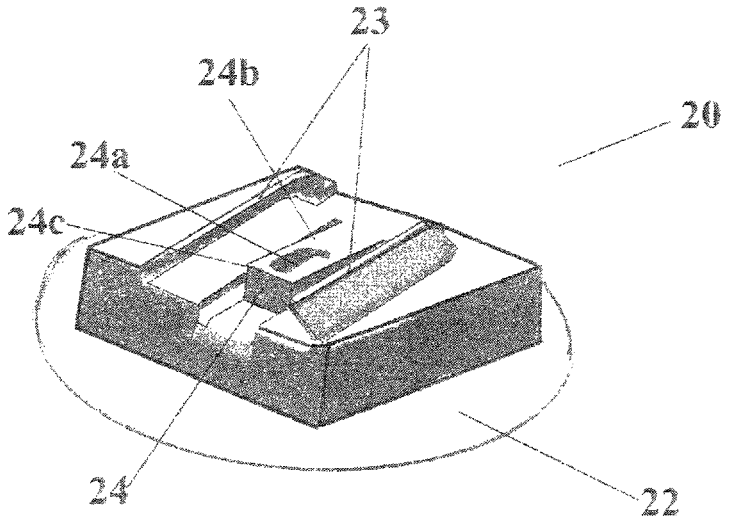
FIG. 3 illustrates another view of the bag's fitting in order to show in detail the flexible stripe.

FIG. 3 illustrates another view of the bag's fitting 20 in order to show in detail the flexible stripe 24. The flexible stripe 24 is a part of the fitting, which is connected in the passage by its edges and is capable of moving up and down. While the fitting 20 is slides in, the stripe adjusts itself to the dispenser's outlet and the corner 24*c* of the raised surface 24*b* removes any leftover foam that may remain in the dispenser's outlet. The passage 24*a* in the raised surface of the flexible stripe 24, enables the foam to pass through, from the dispenser into the bag.

Figure 4:
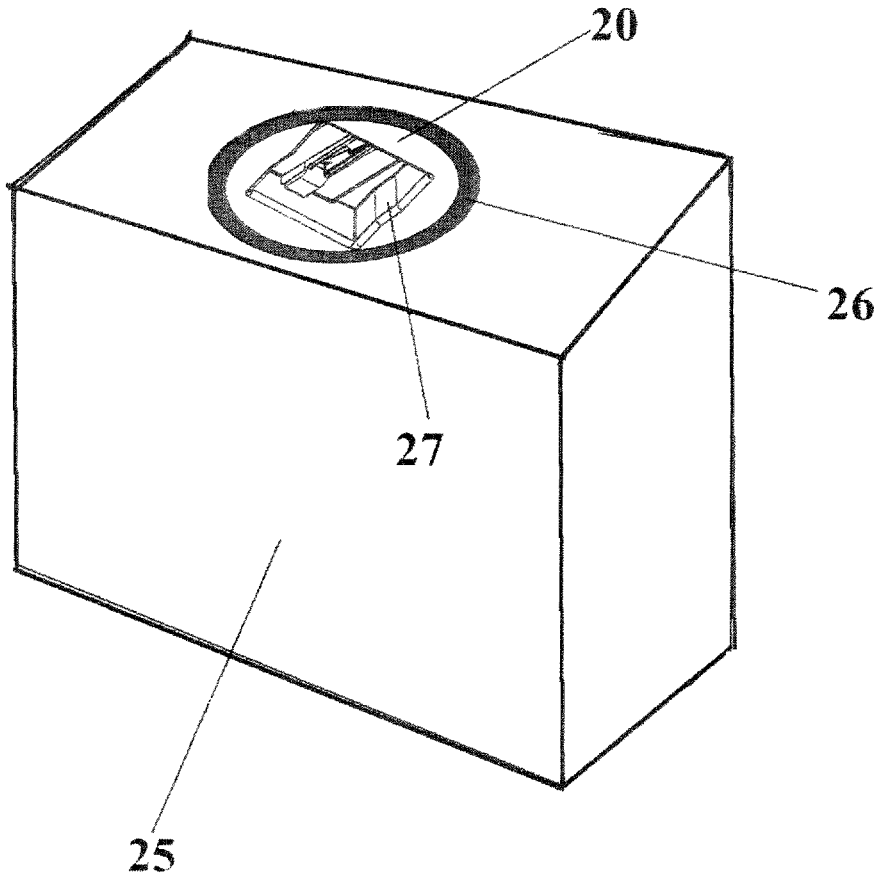
FIG. 4 illustrates the other aspect of the present invention—a bag with a fitting assembled as one unit ready for use.

FIG. 4 illustrates the other aspect of the present invention—a bag with a fitting assembled as one unit ready for use. The opening of the bag 25 is welded or glued 26 to the fitting 20. For filling the bag 25 with dispensed foam, the bag is attached via the fitting to the dispenser's outlet. While sliding-in the fitting, the blade removes any leftover foam and the dispenser is ready to supply foam to the bag.

In a preferred embodiment, the fitting includes a reflecting face 27 enables—by way of any sensing method such as a barcode, chip, hologram, holes in particular location or other identification method—to recognize the bag's existence and characters. Moreover, different colors of the fittings enable visual recognition of different bags.

Although the invention has been described in conjunction with specific embodiments thereof, it is evident that many alternatives, modifications and variations will be apparent to those skilled in the art, accordingly, it is intended to embrace all such alternatives, modifications and variations that fall within the spirit and broad scope of the appended claims.

What is claimed is:

1. A bag's fitting comprising:

a lower side adapted to be welded to a bag;

an upper side slidably connectable to a foam dispenser outlet, the upper side further comprising a flexible raised surface for removing leftover foam from the dispenser's outlet upon connection thereto or disconnection therefrom;

at least one passage from the upper side through the lower side for allowing foam to pass from said dispenser outlet into said bag; and wherein said flexible raised surface is any one of: a flexible stripe, a tooth, or a rough portion; and said flexible raised surface slides along the foam dispenser outlet, while inserting or removing said bag's fitting therefrom, thereby removing any foam leftover.

2. The bag's fitting of claim 1, wherein the upper side slidably connects to the foam dispenser outlet by means of any of the following: sliders or edges for sliding into guide rails of the foam dispenser outlet.

3. The bag's fitting of claim 1, further comprising an identification means in order to identify the presence of the bag's fitting at the foam dispenser outlet and/or to identify bag's characters.

4. The bag's fitting of claim 1, wherein said identification means is any of the following: hologram chip, information printed on said bag's fitting, information imprinted on said bag's fitting, hole or holes in a particular location of said bag's fitting.

5. The bag's fitting of claim 3, wherein said identification means includes providing a hole at a particular location of the bag's fitting to allow passage of light from a light source of the foam dispenser to a light sensor of the foam dispenser.

6. A bag coupled to the bag's fitting of claim 1.

* * * * *